US006802168B1

(12) United States Patent
Minnick

(10) Patent No.: US 6,802,168 B1
(45) Date of Patent: Oct. 12, 2004

(54) MODULAR WALL PANEL SYSTEM WITH COOPERATIVELY TAPERED CONNECTOR PINS AND SLOTS

(76) Inventor: Larry A. Minnick, 1747 Sebring Hills Dr., Henderson, NV (US) 89052

( * ) Notice: Subject to any disclaimer, the term of this patent is extended or adjusted under 35 U.S.C. 154(b) by 13 days.

(21) Appl. No.: 10/308,353

(22) Filed: Dec. 3, 2002

(51) Int. Cl.[7] ..... E04B 2/08

(52) U.S. Cl. ..... 52/592.1; 52/271; 52/578; 312/265.5; 248/224.51

(58) Field of Search ..... 312/265.5; 52/36.1, 52/288, 286, 285.4, 582.1, 585.1, 592.1, 271, 378, 578; 160/135, 229.1, 351; 248/224.51, 224.61; 403/116, 253, 254, 255

(56) References Cited

U.S. PATENT DOCUMENTS

| | | | | | |
|---|---|---|---|---|---|
| 2,970,677 | A | | 2/1961 | Springs et al. | 52/769 |
| 3,286,423 | A | * | 11/1966 | Donlon | 52/287.1 |
| 3,513,606 | A | | 5/1970 | Jones | 52/27 |
| 3,788,378 | A | * | 1/1974 | Sobel | 160/135 |
| 3,908,320 | A | | 9/1975 | Hogue | 52/36 |
| 4,067,165 | A | | 1/1978 | Timmons | 52/585.1 |
| 4,109,429 | A | | 8/1978 | Whisson | 52/122 |
| 4,272,930 | A | * | 6/1981 | Foster | 52/79.1 |
| 4,274,242 | A | | 6/1981 | Linton et al. | 52/741 |
| 4,363,201 | A | | 12/1982 | Bains | 52/584 |
| 4,422,277 | A | | 12/1983 | Bains | 52/584.1 |
| 4,677,797 | A | * | 7/1987 | Roth | 52/94 |
| 4,862,660 | A | | 9/1989 | Raymond | 52/221 |
| 4,881,349 | A | | 11/1989 | Brown et al. | 52/127.11 |
| 4,955,743 | A | * | 9/1990 | King | 403/254 |
| 5,025,937 | A | * | 6/1991 | King | 211/192 |
| 5,054,255 | A | | 10/1991 | Maninfior | 52/239 |
| 5,065,559 | A | | 11/1991 | Zegel et al. | 52/239 |
| 5,287,666 | A | | 2/1994 | Frascaroli et al. | 52/239 |
| 5,412,916 | A | * | 5/1995 | Kennedy et al. | 52/262 |
| 5,561,960 | A | | 10/1996 | Minnick et al. | 52/578 |
| 6,174,065 | B1 | | 1/2001 | Schurch | 362/31 |
| 6,295,771 | B1 | | 10/2001 | Desjoyaux et al. | 52/169.7 |

FOREIGN PATENT DOCUMENTS

| | | | | |
|---|---|---|---|---|
| FR | 1137278 | | 5/1957 | |
| JP | 6158754 A | * | 6/1994 | 52/582.1 |

* cited by examiner

*Primary Examiner*—Anita King
*Assistant Examiner*—Jon Szumny
(74) *Attorney, Agent, or Firm*—William F. Bahret

(57) ABSTRACT

A modular wall panel system in which individual panels are constructed with a lightweight aluminum frame. In a preferred embodiment, the frame is substantially filled with a foam core material and decorative display surfaces are affixed to opposite sides thereof. One edge of each panel contains a plurality of ball-shaped connector pins, while the opposite edge has a plurality of connector slots having a diamond configuration. A similar panel placed adjacent to the first panel may be mated thereto by engagement of the connector pins with respective connector slots in the other panel. The pins/slots are shaped and sized so that the connector pin may enter/exit the connector slot at a wide region thereof but not in the apex region thereof. Secure coupling with fast assembly/disassembly is thereby achieved, without tools or detachable components.

18 Claims, 6 Drawing Sheets

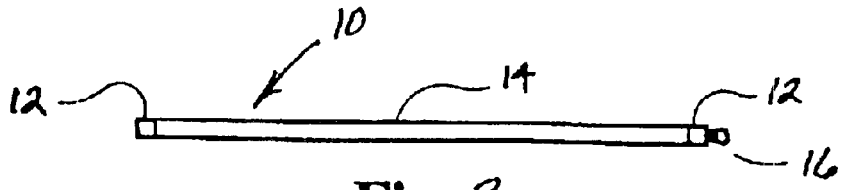
Fig. 3
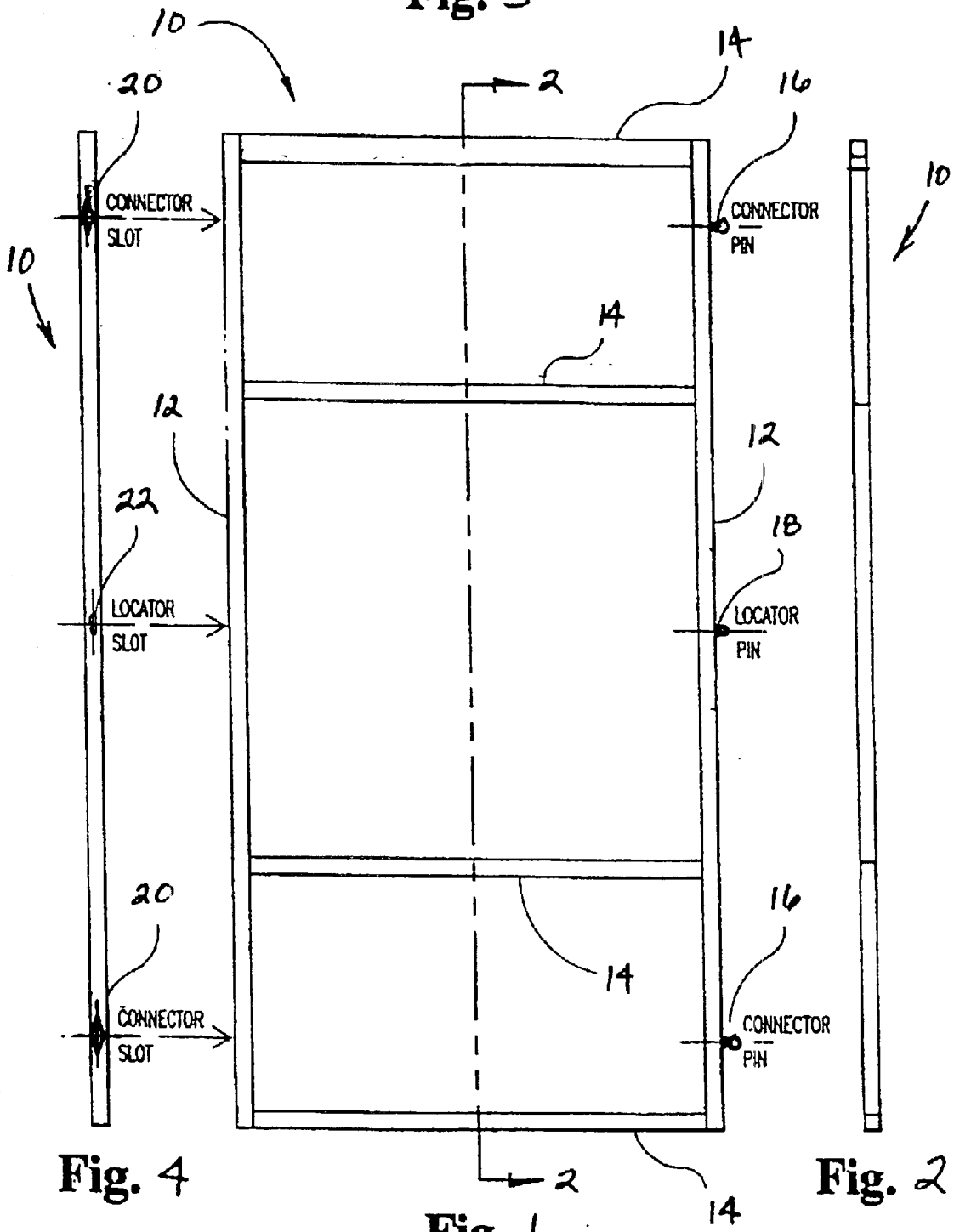
Fig. 4
Fig. 2
Fig. 1

MODULAR WALL PANEL SYSTEM WITH COOPERATIVELY TAPERED CONNECTOR PINS AND SLOTS

BACKGROUND OF THE INVENTION

The present invention relates generally to a modular wall panel system and, more particularly, to a modular wall panel system which allows for interconnection of adjacent panels without the need for tools and/or detachable parts.

Exhibits and displays have found wide usage in today's business and marketing environment, particularly with respect to businesses that participate in conventions, trade shows, seminars and other such events. Also, static or mobile exhibits and displays are used in places such as museums and building lobbies. Due to the nature of these applications, such exhibits and displays are typically assembled and disassembled by a limited number of persons within a limited period of time at the exhibition site. Thus, a basic design requirement of such portable display devices is a minimization of weight and structural complexity, coupled with a maximization of durability and aesthetic appearance. In the extremely competitive sales environments in which trade show exhibits are commonly used, the owner is usually not willing to sacrifice durability or aesthetic appearance.

The conventional tradeshow exhibit is a semi-permanent reusable display designed for long-term usage. These are generally custom fabricated, and are durable, allowing for frequent reuse. For transport, the displays must be broken down into numerous component parts, which are then crated for shipping. In a typical installation, such assemblies must be received at a proper loading dock and assembled by the exhibit site personnel. Frequently, only venue employees are allowed to unload and construct the exhibit display. This can dramatically increase the costs of setting up a large exhibit. Such costs are based upon the manpower required to unload and assemble the exhibit display and the time required for doing so Light, easily assembled panels minimize such costs.

There is a need for lightweight, custom designed, durable, aesthetic display systems that may be easily assembled and disassembled at exhibit trade shows. The present invention is directed toward meeting this need.

SUMMARY OF THE INVENTION

The present invention provides a modular wall panel construction in which one edge of a panel contains a plurality of tapered connector pins and the opposite edge has a plurality of tapered connector slots which in certain embodiments have a "diamond" or a "V" configuration. Two such panels may be interconnected by engagement of the connector pins of one panel with respective connector slots in the other panel. The pins/slots are shaped and sized so as to cooperate to draw adjacent panels together edgewise as the panels are interconnected. Secure coupling with fast assembly/disassembly is thereby achieved, without tools or detachable components.

Other aspects of the present invention will be apparent from the following descriptions of preferred embodiments with reference to the accompanying drawings.

BRIEF DESCRIPTION OF THE DRAWINGS

FIG. 1 is a front elevational view of an embodiment of a panel of the present invention.

FIG. 2 is a cross sectional view of the panel of FIG. 1 taken along plane 2—2 and viewed in the direction of the arrows.

FIG. 3 is a top plan view of the panel of FIG. 1.

FIG. 4 is a left side elevational view of the panel of FIG. 1.

DETAILED DESCRIPTION OF THE PREFERRED EMBODIMENTS

Figure 5:
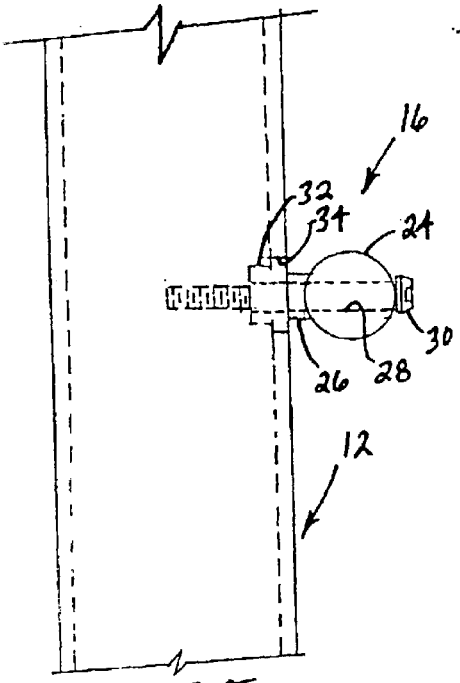
FIG. 5 is an enlarged front elevational view of a connector pin of the panel of FIG. 1.
Figure 6:
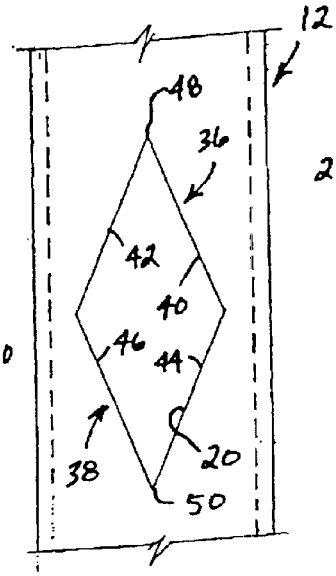
FIG. 6 is an enlarged left side elevational view of a connector slot of the panel of FIG. 1.
Figure 7:
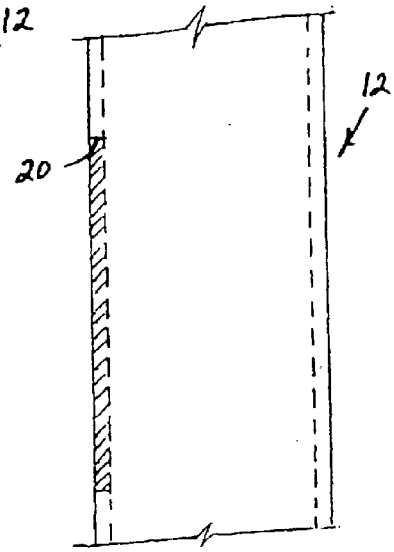
FIG. 7 is an enlarged front elevational view of the connector slot of FIG. 6.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides a modular panel wall system having individual wall panels that are light enough to be handled by a single person. The panels are approximately one half the thickness of conventional 4" thick panels, which saves space during shipping. Even so, the panels of the present invention are rigid, aesthetic and durable. Furthermore, the modular wall panels of the present invention include a system for interconnecting adjacent panels that does not require any tools or separate parts to effect the connection.

Referring to FIG. 1, there is illustrated an embodiment of a wall panel of the present invention, indicated generally at 10. Each of the panels 10 has a frame formed from vertical support members 12 and horizontal support members 14. Both the vertical support members 12 and the horizontal support members 14 are formed from aluminum. In a preferred embodiment, the vertical support members 12 are formed from substantially square aluminum tubing having dimensions of 2"×2". Also in a preferred embodiment, the horizontal support members 14 are formed from 2"×3" aluminum U-channel members. The horizontal cross members 14 are affixed to the vertical support members 12 by any convenient means, such as by welding. The use of aluminum in the frame construction of the modular panel 10 results in a modular panel that is light and thin, yet strong and rigid. The horizontal support members 14 are formed from U-channel material rather than from full tubes in order to further decrease the weight of the finished unit and facilitate their use as wire channels for carrying electrical wires associated with the display. The placement of the horizontal support members 14 is illustrated in the cross sectional view of FIG. 2. The configuration of the vertical support members 12 is more clearly illustrated in the plan view of FIG. 3.

Figure 12:
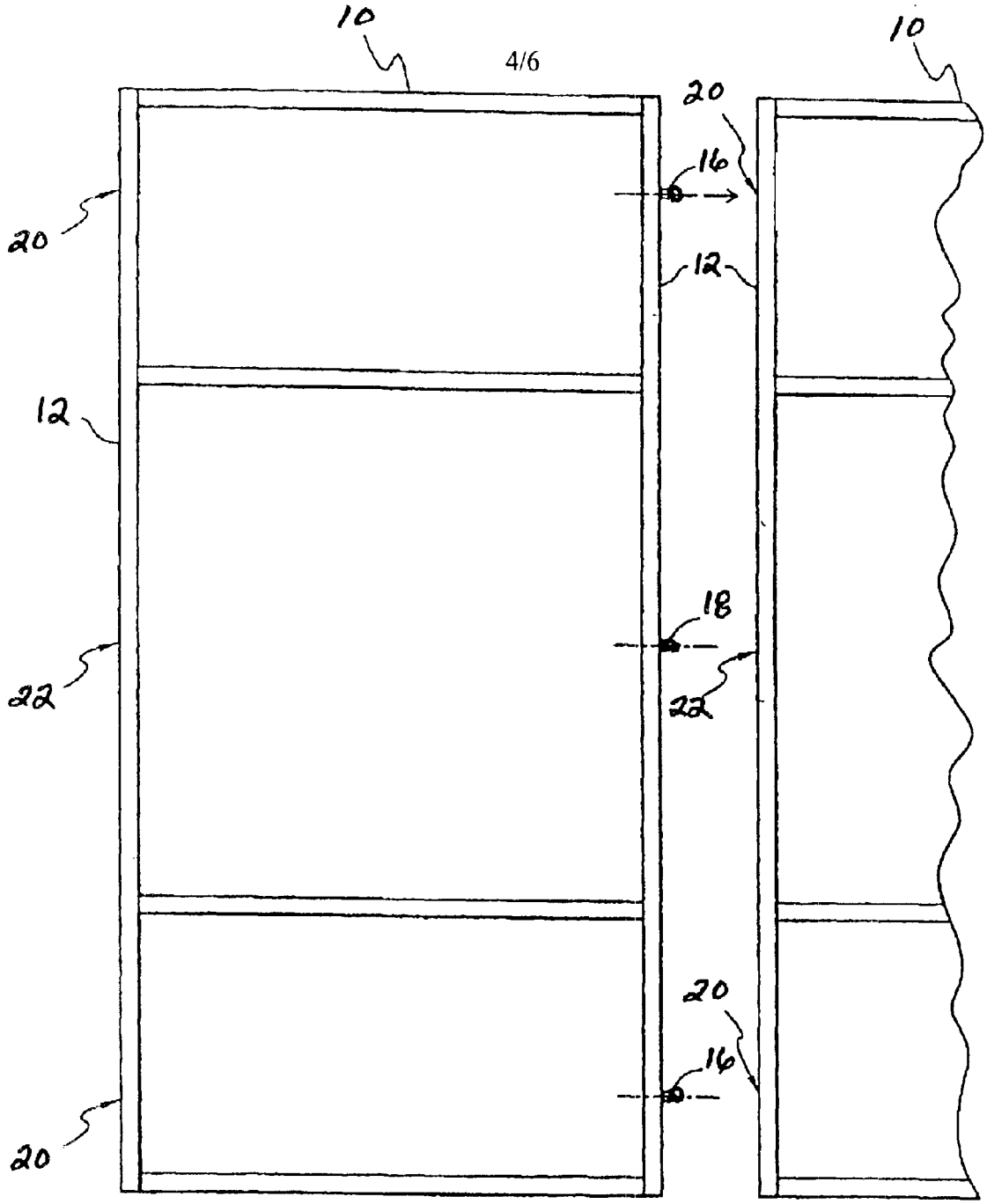
FIG. 12 is an elevational view of an embodiment of the present invention, showing connection between adjacent display panels.

The right side of each modular wall panel 10 is provided with two tapered pins 16, specifically, ball connector pins, located near the upper and lower ends thereof. Furthermore, a locator pin 18 is coupled to the right side of the wall panel 10 substantially in the middle of the right hand vertical support member 12. Referring to FIG. 4, each wall panel 10 further includes two connector slots 20 formed in the left hand vertical support member 12 thereof at generally the same vertical locations as the ball connector pins 16. A locator slot 22 is formed in the left hand vertical support member 12 at the same vertical location as the locator pin 18. As described in greater detail hereinbelow, and as illustrated generally in FIG. 12, the ball connector pins 16 are designed to fit in locking engagement with the connector slots 20 of an adjacent wall panel 10. In a typical case where adjacent panels are designed to rest directly on a level surface, the nominal position of a given pin is offset vertically from the center of a corresponding slot in order to facilitate such locking engagement when the panels are interconnected. Likewise, the locator pins 18 are designed to engage the locator slot 22 of an adjacent wall panel 10, although the locator pin does not fit in locking engagement with the locator slot. The use of the pins and complementary slots in the embodiment of the present invention allows for adjacent wall panels 10 to be coupled to one another without the use of any tools and without requiring separate parts which may become separated from the wall panels 10. Furthermore, the connector pin/connector slot arrangement of the present invention allows for extremely quick assembly and disassembly of the exhibit display, dramatically reducing the costs associated with these operations.

With reference to FIGS. 5–7 and 11, the ball connector pin 16 and connector slot 20 engagement is illustrated in greater detail. The ball connector pin 16 is preferably formed from an aluminum spherical ball 24 and an aluminum spacer 26 that is generally disk shaped. One side of spacer 26 is flat to engage vertical support member 12 and the other side is concave to engage and mate with the surface of the spherical ball 24. The ball 24 and spacer 26 each have a central bore 28 therethrough to receive and accommodate an alien head machine screw 30 that extends diametrically through the ball 24 and through the center of the spacer 26. Ball connector pin 16 is joined to the vertical support member 12 by allen head machine screw 30 threadingly engaging a threaded insert 32 that is held in the vertical support member 12 by an interference fit with a mounting hole 34 formed for this purpose. The largest exterior dimension of the ball connector pin 16 is the diameter of the spherical ball 24. The thickness of spacer 26 along the axis of the pin is about equal to the wall thickness of the vertical support member 12 having connector slot 20.

Figure 11:
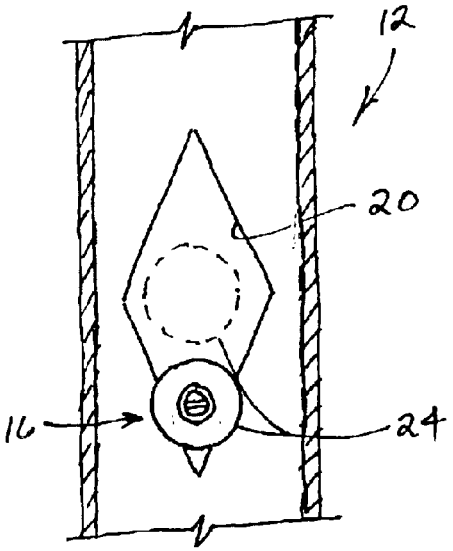
FIG. 11 is an enlarged elevational view of the connector slot of FIG. 6 in which the connector pin of FIG. 5 is received in the locked position.

The connector slot 20 is a tapered slot, specifically, a diamond-shaped slot, comprised of combined upper and lower triangular openings 36 joined at their bases and each defined by a pair of substantially straight side walls 40,42 and 44,46, respectively, that converge toward oppositely extending upper and lower apexes 48, 50. The center width of the diamond slot 20 is chosen to be larger than the diameter of the spherical ball 24 of the ball connector pin 16. The ball connector pin 16 may be inserted through the center region of the diamond connector slot 20 until the spherical ball connector pin 16 lies substantially within the vertical support member 12. At this point the ball connector pin 16 may be slid toward the upper or lower apexes 48, 50 wherein the spherical ball 24 of connector pin 16 is thereby locked within the connector slot 20. If, for example, the pin in a first panel is nominally positioned below the center of its corresponding slot in an adjacent panel, the first panel is raised to allow insertion of the pin into the slot of the adjacent panel and the first panel is then lowered whereby the pin slides toward the lower apex 50. Because the diameter of the spherical ball 24 of the ball connector pin 16 is larger than the converging width of the slot 20 toward the apexes 48, 50, the ball connector pin 16 is prevented from exiting the connector slot 20 when it is arranged at either the upper or lower portion of slot 20. Thus, the two adjacent wall panels 10 are effectively locked together once the ball connector pin 16 has been properly inserted into the connector slot 20. FIG. 11 shows the position of the spherical ball 24 relative to connector slot 20 in the unlocked position (phantom lines) and the locked position (solid lines).

The spherical surface of ball 24, adjacent spacer 26, that faces vertical support member 12 diverges therefrom to form a cam surface that can engage the converging side walls 40,42 or 44,46 of connector slot 20 and draw adjacent panels 10 together as connector pin 16 is moved toward one apex 48 or the other apex 50 of slot 20. Conversely, the spherical surface of ball 24, adjacent spacer 26, that faces vertical support member 12 can be said to taper toward support member 12. The spherically curved surface of ball 24 interacting with the V-shape of one end of slot 20 causes a variable taper or wedging action that allows for easy initial alignment and engagement of the connector pin 16 and connector slot 20, followed by a tight wedging action to hold adjacent panels 10 together. The angle of divergence of the spherical surface of ball 24 relative to vertical support member 12 decreases in the direction toward support member 12, causing an increase in the wedging force against the side walls 40,42 or 44,46.

Provision of mating ball connector pins 16/connector slots 20 near the top and bottom of each modular wall panel 10 insures the panels 10 will be rigidly coupled together. Because both the ball connector pin 16 and the connector slot 20 are formed from similar aluminum materials, there is little if any appreciable wear on either member, virtually insuring the connector system of the present invention will outlast the useful life of the modular wall panel 10.

Figure 8:
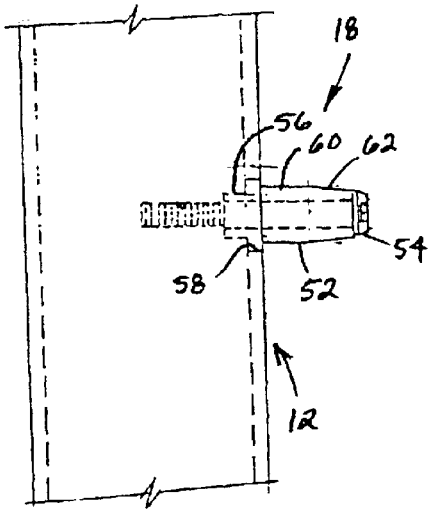
FIG. 8 is an enlarged front elevational view of a locator pin of the panel of FIG. 1.
Figure 9:
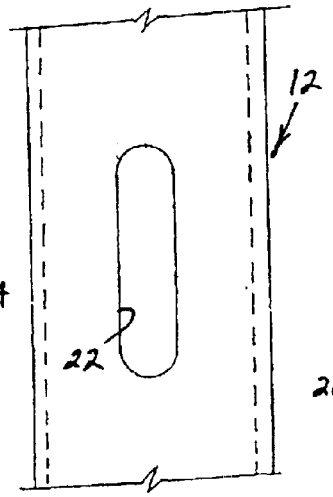
FIG. 9 is an enlarged left side elevational view of a locator slot of the panel of FIG. 1.
Figure 10:
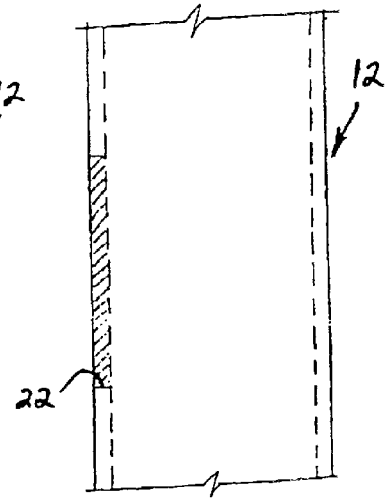
FIG. 10 is an enlarged front elevational view of the locator slot of FIG. 9.

As best illustrated in FIGS. 8–10, the locator pin 18 is formed from a generally cylindrical member 52 which is attached to the vertical support member 12 by an alien head machine screw 54. The screw 54 threadingly engages a threaded insert 56 which is maintained in the vertical support member 12 by an interference fit with a mounting hole 58 formed therein for this purpose. The locator pin 18 has a constant diameter in a first portion 60 from its root through substantially about one half of its entire length, followed by a frusto-conical portion 62 that converges toward the free end of pin 18. Furthermore, the locator slot 22 has substantially the same width throughout its entire length. The width of the locator slot 22 is chosen to be slightly larger than the width of the cylindrical portion 60 of the locator pin 18. Therefore, the engagement of the locator pin 18 with the locator slot 22 does not result in any locking engagement between adjacent wall panels 10. Rather, the locator pin 18/locator slot 22 combination is provided merely as an alignment guide which facilitates the proper mating of the two ball connector pins 16 with their respective connector slots 20.

It will be appreciated by those skilled in the art that the use of the specially shaped ball connector pin 16 and the connector slot 20 having a diamond shape allows for assembly and disassembly of adjacent wall panels 10. For example, once the wall panels 40 are assembled, disassembly of the panels requires that one panel be raised vertically relative to its adjacent neighbor so that the ball connector pins 16 may be aligned with the wide center portion of the diamond connector slots 20 and removed therefrom.

As an alternative construction of panel 10, another embodiment is formed from the same frame construction as the first embodiment wall panel 10, and further includes the same ball connector pin 16/connector slot 20 and locator pin 18/locator slot 22 configuration. However, the spaces between adjacent horizontal support members 14 in the wall panel 10 are filled with 2" thick cellulose foam material. The sections of foam are sized to substantially completely fill the space within the frame of the modular panel 10, with the exception that the U-channels within the horizontal support members 14 remain unfilled. Both sides of the modular panel 10 are then covered with a decorative laminate material, such as plastic laminate commonly known in the art and manufactured by Formica®, Wilsonart®, etc. The outer laminate is coupled to the foam and/or frame of the modular panel 10 by any convenient means, such as a spray adhesive.

Because of the low density and high strength of the cellulose foam material, its addition to the structure of the modular panel 10 adds essentially no weight to the finished structure, however, it is very effective in providing rigidity to the entire structure. The foam material is especially useful in preventing deformation of the laminate material when subjected to forces perpendicular to its surface. Optionally, an elongate hole may be cut entirely through the modular panel 10 in order to provide a convenient hand hold for carrying the modular panel 10. Because the modular panel 10 is light enough to be carried with one hand, the positioning of the hole substantially in the center of the modular panel 10 facilitates lifting and carrying of the panel. It will be appreciated by those skilled in the art that the hole will not be seen in the final constructed exhibit display if graphics or other materials are mounted onto the modular panel 10, as is usually the case.

Figure 13:
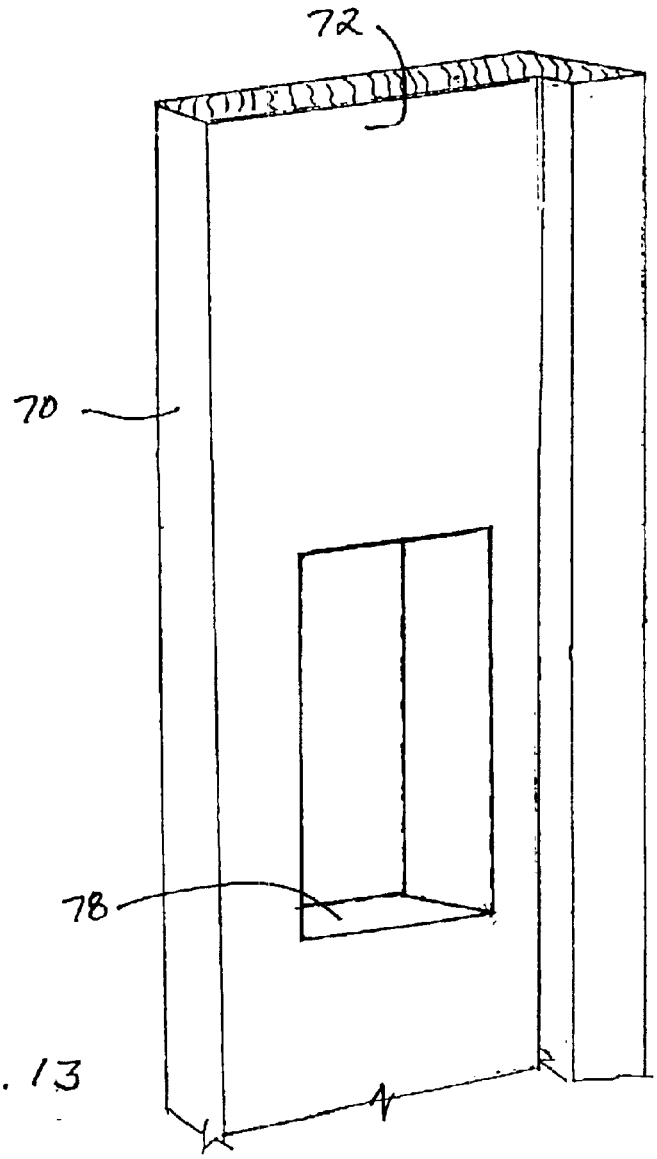
FIG. 13 is a perspective view of another embodiment of a panel of the present invention.

Referring now to FIGS. 13–17, there is illustrated an alternative embodiment of the present invention that is particularly suited for adapting a typical wood panel to utilize the ball connector pin and diamond connector slot arrangement discussed above with respect to panel 10. FIG. 13 shows a typical nominal 1"×4"(¾"×3 ⅝" actual dimensions) wood frame member 70 that would comprise one vertical support member of a typical wood panel. Such a panel can be adapted to incorporate the present invention by routing the face of the wood frame member 70 to form a recessed channel 72 preferably about 2" wide, ⅛" deep, and the height of the panel. A male adapter plate 74 or a female adapter plate 76, either having a length substantially the same as the height of the panel, can be received and affixed within the recessed channel 72 so that the adapter plate 74 or 76 is flush with the original surface of frame member 70. To effect this, the recessed channel 72 is routed to a depth substantially equal to the thickness of the adapter plate 74 or 76.

Figure 15:
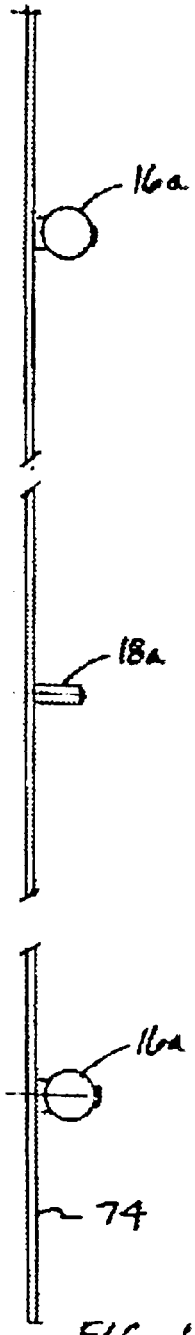
FIG. 15 is a side elevational view of the male adapter plate of FIG. 14.
Figure 14:
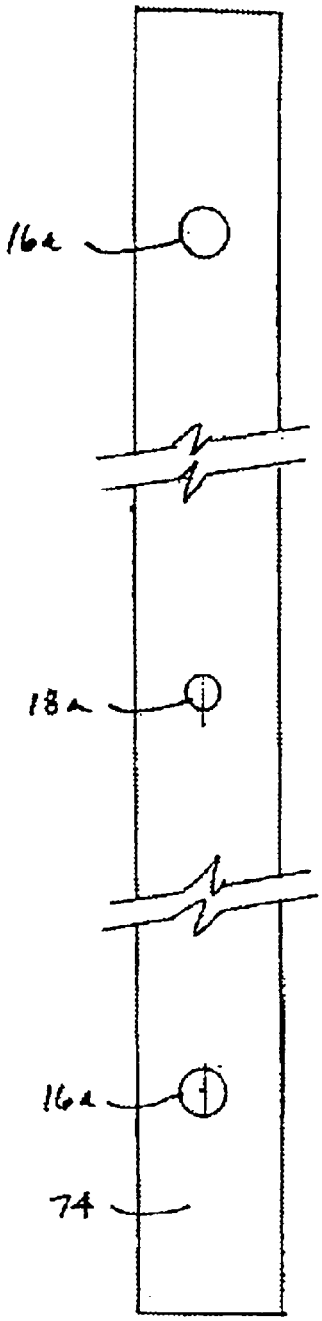
FIG. 14 is a front elevational view of an embodiment of a male adapter plate for use with the panel of FIG. 13.

With particular reference to FIGS. 14–15, a ⅛"×2" male adapter plate 74 is shown. Connector pins 16*a* and locator pin 18*a* are affixed to adapter plate 74 in the same manner and in the same locations that connector pins 16 and 18 are affixed to vertical support member 12 as described above. In their configuration and construction, and manner of attachment to adapter plate 74, connector pins 16*a* and locator pin 18*a* are substantially identical to the previously described connector pins 16 and locator pin 18.

Figure 17:
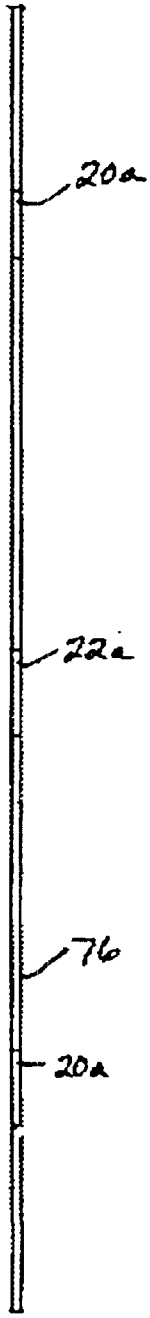
FIG. 17 is a side elevational view of the female adapter plate of FIG. 15.
Figure 16:
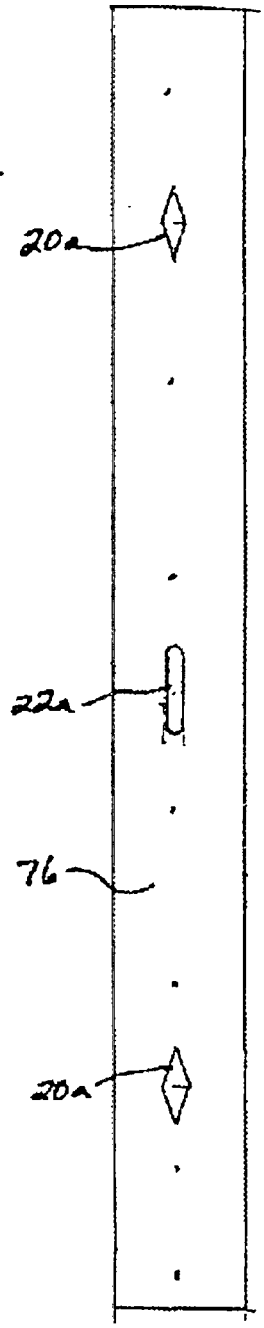
FIG. 16 is a front elevational view of an embodiment of a female adapter plate for use with the panel of FIG. 13.

Referring now to FIGS. 16–17, a ⅛"×2" female adapter plate 76 is shown. Connector slots 20*a* and locator slot 22*a* are formed in adapter plate 76 in the same manner and in the same locations that connector slots 20 and locator slot 22 are formed in vertical support member 12 as described above. In their configuration and construction, connector slots 20*a* and locator slot 22*a* are substantially identical to the previously described connector slots 20 and locator slot 22 in vertical support member 12. Referring again to FIG. 13, because female, adapter plate 76 is backed by wood frame member 70, recesses 78 are routed in the channel 72 of frame member 70 and aligned with connector slots 20*a* and locator slot 22*a* to provide clearance for the connector pins 16*a* and locator pin 18*a* to be received through female adapter plate 76.

Figure 18:
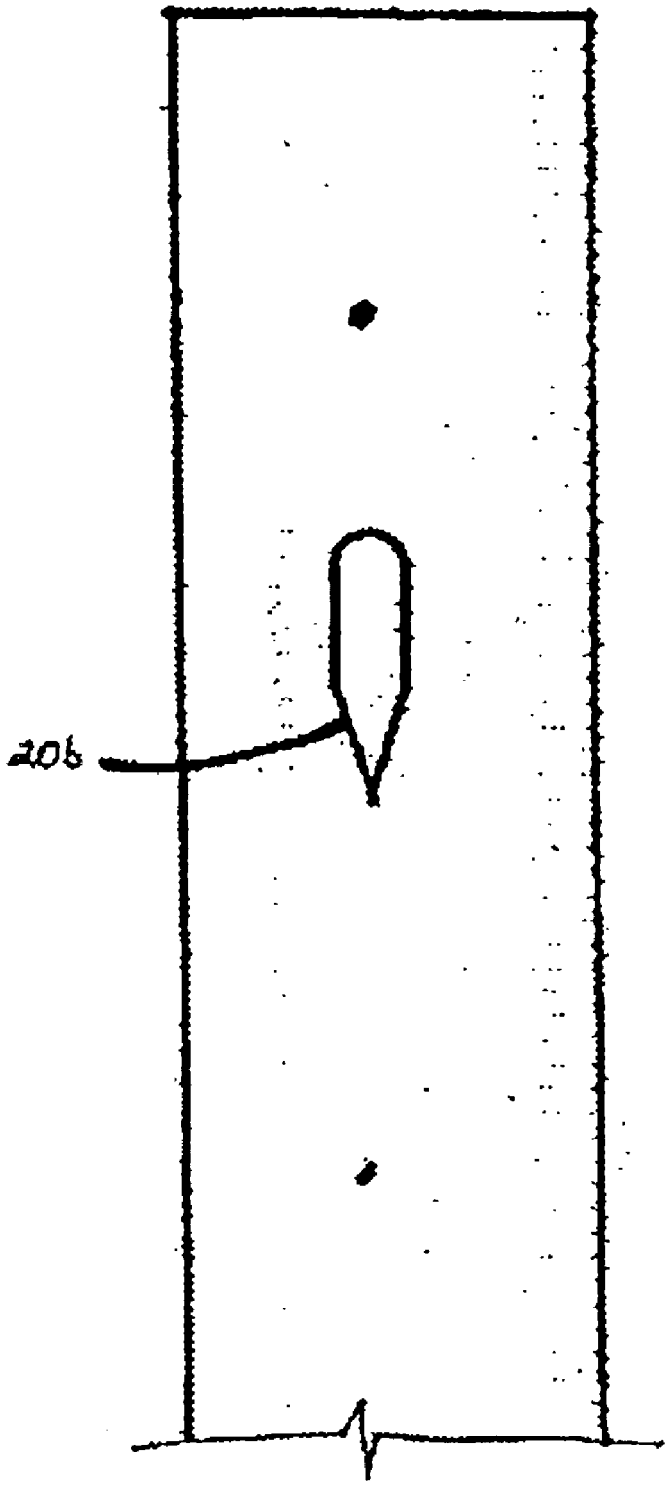
FIG. 18 is an alternative embodiment of the connector slot of the left side of the panel of FIG. 1 or the female adapter plate of FIG. 16.

As shown in FIG. 18, an alternative embodiment of the present invention is shown that can be made substantially identical to any of the previously described embodiments except that the connector slots 20*b* are V-shaped at only one end, the opposite end of the slot being any shape that permits the ball connector pin 16 to pass through. The V-shaped end of the connector slot can be oriented upwardly or downwardly. If the V-shaped end of slot 20*b* is oriented downwardly as shown in FIG. 18, wherein the V-shaped end appears as an upright "V", then the panel having the male connector pins 16*a* should be lifted relative to the other panel, the pins should be passed through the connector slots, and the panel with the connector pins 16*a* should be lowered to lock the panels together. If the V-shaped end of slot 20*b* is oriented upwardly, then the panel having the female connector slots 20*b* must be lifted relative to the other panel, the pins passed through the connector slots 20*b*, and the first panel with the connector slots 20*b* should be lowered to lock the panels together.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A modular wall panel, comprising:

a panel frame having first and second vertical support members;

a plurality of connector pins coupled to the first vertical support member and extending from said panel frame substantially horizontally, each of the connector pins having a convex substantially spherical surface spaced from, facing, and diverging from said panel frame;

a plurality of connector slots formed in the second vertical support member, each of the connector slots having a V-shaped portion, having a wide region of sufficient width to receive the connector pin therethrough, and converging to a width in said V-shaped portion sufficiently narrow to retain the connector pin therein;

a locator pin coupled to the first vertical support member and extending substantially horizontally, the locator pin having a diameter; and a locator slot formed in the second vertical support member, the locator slot having a width that is larger than the diameter of the locator pin;

wherein adjacent modular wall panels may be releasably coupled by vertically raising one panel with respect to the other panel until the connector pins of one of the panels are aligned with the wide region of the corresponding connector slots of the other of the panels, moving the panels toward each other and then vertically lowering the one panel to substantially a level of the other panel such that each of the connector pins is disposed within the V-shaped portion of the corresponding connector slot; and wherein the locator pin includes a first cylindrical portion and further comprises a machine screw extending longitudinally through the first cylindrical portion and threadingly engaging the first vertical support member, thereby coupling the locator pin to the first vertical support member.

2. A modular wall panel, comprising:

a panel frame having first and second vertical support members;

a plurality of connector pins coupled to the first vertical support member and extending from said panel frame substantially horizontally, each of the connector pins having a convex substantially spherical surface spaced from, facing, and diverging from said panel frame; and a plurality of connector slots formed in the second vertical support member, each of the connector slots having a V-shaped portion, having a wide region of sufficient width to receive the connector pin therethrough, and converging to a width in said V-shaped portion sufficiently narrow to retain the connector pin therein;

wherein adjacent modular wall panels may be releasably coupled by vertically raising one panel with respect to the other panel until the connector pins of one of the panels are aligned with the wide region of the corresponding connector slots of the other of the panels, moving the panels toward each other and then vertically lowering the one panel to substantially a level of the other panel such that each of the connector pins is disposed within the V-shaped portion of the corresponding connector slot; and wherein each of the connector slots is diamond-shaped.

3. The modular wall panel of claim 2, further comprising:

a locator pin coupled to the first vertical support member and extending substantially horizontally, the locator pin having a diameter; and a locator slot formed in the second vertical support member, the locator slot having a width that is larger than the diameter of the locator pin.

4. The modular wall panel of claim 2, wherein each of the connector pins comprise:

a spacer having a diameter; and a sphere having a diameter greater than the diameter of the spacer.

5. The modular wall panel of claim 2, wherein the panel frame includes horizontal support members formed from U-shaped channel material.

6. The modular wall panel of claim 2, wherein each vertical support member includes a wood frame member and a plate affixed thereto, said plate of said second vertical support member having a plurality of diamond-shaped slots formed therein.

7. A modular wall panel, comprising:

a panel frame having first and second vertical support members;

a plurality of connector pins coupled to the first vertical support member and extending from said panel frame substantially horizontally, each of the connector pins having a convex substantially spherical surface spaced from, facing, and diverging from said panel frame;

a plurality of connector slots formed in the second vertical support member, each of the connector slots having a V-shaped portion, having a wide region of sufficient width to receive the connector pin therethrough, and converging to a width in said V-shaped portion sufficiently narrow to retain the connector pin therein;

a spacer having a diameter; and a sphere having a diameter greater than the diamter of the spacer;

wherein adjacent modular wall panels may be releasably coupled by vertically raising one panel with respect to the other panel until the connector pins of one of the panels are aligned with the wide region of the corresponding connector slots of the other of the panels, moving the panels toward each other and then vertically lowering the one panel to substantially a level of the other panel such that each of the connector pins is disposed within the V-shaped portion of the corresponding connector slot; and wherein each of the connector pins further comprises a machine screw extending longitudinally through the spacer and sphere and threadingly engaging the first vertical support member, thereby coupling the connector pin to the first vertical support member.

8. A modular wall panel, comprising:

a panel frame having first and second vertical support members;

a plurality of connector pins coupled to the first vertical support member and extending from said panel frame substantially horizontally, each of the connector pins having a convex substantially spherical surface spaced from, facing, and diverging from said panel frame; and a plurality of connector slots formed in the second vertical support member, each of the connector slots having a V-shaped portion, having a wide region of sufficient width to receive the connector pin therethrough, and converging to a width in said V-shaped portion sufficiently narrow to retain the connector pin therein;

wherein adjacent modular wall panels may be releasably coupled by vertically raising one panel with respect to the other panel until the connector pins of one of the panels are aligned with the wide region of the corresponding connector slots of the other of the panels, moving the panels toward each other and then vertically lowering the one panel to substantially a level of the other panel such that each of the connector pins is disposed within the V-shaped portion of the corresponding connector slot; and wherein the first and second vertical support members are formed from substantially square tubing.

9. The modular wall panel of claim 8, further comprising:

a locator pin coupled to the first vertical support member and extending substantially horizontally, the locator pin having a diameter; and a locator slot formed in the second vertical support member, the locator slot having a width that is larger than the diameter of the locator pin.

10. The modular wall panel of claim 8, wherein the panel frame includes horizontal support members formed from U-shaped channel material.

11. The modular wall panel of claim 8, wherein each of the connector pins comprise:

a spacer having a diameter; and a sphere having a diameter greater than the diameter of the spacer.

12. A modular wall panel, comprising:

a panel frame having first and second vertical support members; and cooperating means including a taper for drawing adjacent panels toward each other, said means including a plurality of connector pins coupled to the first vertical support member and extending from said panel frame substantially horizontally; and a plurality of diamond-shaped connector slots formed in the second vertical support member;

wherein adjacent wall panels may be releasably coupled by vertically raising one panel with respect to the other panel until the connector pins of one of the panels are aligned with the corresponding connector slots of the other of the panels, moving the panels toward each other and then vertically lowering the one panel to substantially a level of the other panel such that each of the connector pins is retained by the corresponding connector slot.

13. The modular wall panel of claim 12, wherein the connector pins of the cooperating means have a convex substantially spherical surface spaced from, facing, and diverging from said panel frame.

14. The modular wall panel of claim 12, wherein the connector pins of the cooperating means have a convex substantially spherical surface spaced from, facing and tapering toward said panel frame.

15. A modular wall panel, comprising:

a panel frame having first and second vertical support members formed from substantially square tubing; and cooperating means including a taper for drawing adjacent panels toward each other, said means including a plurality of connector pins coupled to the first vertical support member and extending from said panel frame substantially horizontally; and a plurality of connector slots formed in the second vertical support member;

wherein adjacent modular wall panels may be releasably coupled by vertically raising one panel with respect to the other panel until the connector pins of one of the panels are aligned with the corresponding connector slots of the other of the panels, moving the panels toward each other and then vertically lowering the one panel to substantially a level of the other panel such that each of the connector pins is retained by the corresponding connector slot;

wherein the connector slots of the cooperating means have a V-shape having a wide region of sufficient width to receive the connector pin therethrough, and converging to a width sufficiently narrow to retain the connector pin therein.

16. The modular wall panel of claim 15, wherein the connector slots are diamond-shaped.

17. The modular wall panel of claim 15, wherein the connector pins of the cooperating means have a convex substantially spherical surface spaced from, facing, and diverging from said panel frame.

18. The modular wall panel of claim 15, wherein the connector pins of the cooperating means have a convex substantially spherical surface spaced from, facing and tapering toward said panel frame.

* * * * *

UNITED STATES PATENT AND TRADEMARK OFFICE

CERTIFICATE OF CORRECTION

PATENT NO. : 6,802,168 B1
DATED : October 12, 2004
INVENTOR(S) : Minnick

It is certified that error appears in the above-identified patent and that said Letters Patent is hereby corrected as shown below:

Column 1,
Line 40, please change “so Light,” to -- so. Light --.

Column 3,
Line 60, please change “alien” to -- allen --.

Column 4,
Line 63, please change “alien” to -- allen --.

Column 9,
Line 30, please change “adjacent wall” to -- adjacent modular wall --.

Signed and Sealed this

Twentieth Day of December, 2005

JON W. DUDAS
*Director of the United States Patent and Trademark Office*